US010465671B2

(12) United States Patent
Hahn

(10) Patent No.: US 10,465,671 B2
(45) Date of Patent: Nov. 5, 2019

(54) COMPRESSOR WITH A DISCHARGE MUFFLER

(71) Applicant: Haier US Appliance Solutions, Inc., Wilmington, DE (US)

(72) Inventor: Gregory William Hahn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 204 days.

(21) Appl. No.: 15/440,058

(22) Filed: Feb. 23, 2017

(65) Prior Publication Data

US 2018/0238313 A1 Aug. 23, 2018

(51) Int. Cl.

| | |
|---|---|
| ***F04B 39/00*** | (2006.01) |
| ***F04B 39/12*** | (2006.01) |
| ***F04B 39/10*** | (2006.01) |

(52) U.S. Cl.

CPC ..... *F04B 39/0061* (2013.01); *F04B 39/0005* (2013.01); *F04B 39/1013* (2013.01); *F04B 39/121* (2013.01)

(58) Field of Classification Search

CPC .. F04B 35/045; F04B 39/005; F04B 39/0055; F04B 39/0061; F04B 39/1013; F04B 39/121; F04B 39/123; F25B 2400/073; F25B 2500/12; F25D 23/006; Y10T 137/7936

USPC ..... 417/312, 417

See application file for complete search history.

(56) References Cited

U.S. PATENT DOCUMENTS

| | | | | |
|---|---|---|---|---|
| 860,725 | A | 7/1907 | Bruce | |
| 5,101,931 | A * | 4/1992 | Blass | F04B 39/0055 181/240 |
| 5,722,817 | A | 3/1998 | Park et al. | |
| 6,398,523 | B1 | 6/2002 | Hur et al. | |
| 6,824,365 | B2 * | 11/2004 | Park | F04B 39/0061 181/403 |
| 7,150,605 | B2 | 12/2006 | Kim et al. | |
| 7,921,845 | B2 | 4/2011 | Kim | |
| 8,030,846 | B2 | 10/2011 | Kang et al. | |
| 8,057,200 | B2 * | 11/2011 | Kang | F04B 35/045 181/274 |
| 8,366,415 | B2 | 2/2013 | Kang et al. | |
| 8,496,453 | B2 | 7/2013 | Kang et al. | |
| 8,561,521 | B2 | 10/2013 | Kang et al. | |
| 8,651,834 | B2 | 2/2014 | Lee et al. | |
| 2004/0009077 | A1 | 1/2004 | Seo | |
| 2004/0055582 | A1 * | 3/2004 | Yanase | F02M 25/0836 123/519 |
| 2004/0247457 | A1 | 12/2004 | Kim et al. | |

(Continued)

FOREIGN PATENT DOCUMENTS

KR 100702988 B1 4/2007

*Primary Examiner* — Patrick Hamo
*Assistant Examiner* — Joseph S. Herrmann
(74) *Attorney, Agent, or Firm* — Dority & Manning, P.A.

(57) ABSTRACT

A discharge valve assembly includes an outer shell. An inner sleeve is positioned within the outer shell. A side wall of the inner sleeve is spaced from a side wall of the outer shell along a radial direction. A distal end of the side wall of the inner sleeve is spaced from an end wall of the outer shell by a gap along an axial direction. The inner sleeve divides an interior volume of the outer shell into a first muffler cavity and a second muffler cavity. A related compressor is also provided.

19 Claims, 6 Drawing Sheets

(56) References Cited

U.S. PATENT DOCUMENTS

| | | | | |
|---|---|---|---|---|
| 2005/0142014 | A1 | 6/2005 | Jung et al. | |
| 2006/0093498 | A1 | 5/2006 | Kim | |
| 2006/0153712 | A1* | 7/2006 | Park | F04B 35/045 417/417 |
| 2010/0316513 | A1 | 12/2010 | Lee et al. | |

* cited by examiner

COMPRESSOR WITH A DISCHARGE MUFFLER

FIELD OF THE INVENTION

The present subject matter relates generally to compressors and discharge valves for compressors.

BACKGROUND OF THE INVENTION

Certain refrigerator appliances include sealed systems for cooling chilled chambers of the refrigerator appliance. The sealed systems generally include a compressor that generates compressed refrigerant during operation of the sealed system. The compressed refrigerant flows to an evaporator where heat exchange between the chilled chambers and the refrigerant cools the chilled chambers and food items located therein.

Recently, certain refrigerator appliances have included linear compressors for compressing refrigerant. Linear compressors generally include a piston and a driving coil. The driving coil receives a current that generates a force for sliding the piston forward and backward within a chamber. During motion of the piston within the chamber, the piston compresses refrigerant. A discharge valve regulates a flow of pressured refrigerant from the chamber.

Pressure pulsations within the flow of pressured refrigerant and noise emitted by the linear compressor are undesirable. Mufflers can dissipate the pressure pulsation and reduce noise. However, mufflers can be expensive to produce. For example, mufflers are generally constructed by brazing individual chambers, and brazing is a labor intensive and expensive process.

Accordingly, a compressor with a discharge valve having features for limiting pressure pulsations within discharge refrigerant would be useful.

BRIEF DESCRIPTION OF THE INVENTION

The present subject matter provides a discharge valve assembly. The discharge valve assembly includes an outer shell. An inner sleeve is positioned within the outer shell. A side wall of the inner sleeve is spaced from a side wall of the outer shell along a radial direction. A distal end of the side wall of the inner sleeve is spaced from an end wall of the outer shell by a gap along an axial direction. The inner sleeve divides an interior volume of the outer shell into a first muffler cavity and a second muffler cavity. A related compressor is also provided. Additional aspects and advantages of the invention will be set forth in part in the following description, or may be apparent from the description, or may be learned through practice of the invention.

In a first exemplary embodiment, a compressor is provided. The compressor includes a casing that defines a chamber. A piston is disposed within the chamber of the casing. The piston is reciprocable within the chamber of the casing along an axial direction. A discharge valve assembly includes an outer shell that defines an interior volume. A valve head is positioned within the outer shell adjacent the chamber of the casing. A spring is coupled to the valve head such that the spring urges the valve head towards the casing. An inner sleeve is positioned within the outer shell. A side wall of the inner sleeve is spaced from a side wall of the outer shell along a radial direction. A distal end of the side wall of the inner sleeve is spaced from an end wall of the outer shell by a gap along the axial direction. The inner sleeve divides the interior volume into a first muffler cavity and a second muffler cavity. The side wall of the inner sleeve is positioned between the first muffler cavity and the second muffler cavity along the radial direction. The first muffler cavity is contiguous with the second muffle cavity at the gap between the distal end of the side wall of the inner sleeve and the end wall of the outer shell.

In a second exemplary embodiment, a discharge valve assembly for a compressor is provided. The discharge valve assembly includes an outer shell that defines an interior volume. A valve head is positioned within the outer shell. A spring is positioned within the outer shell and is coupled to the valve head. An inner sleeve is positioned within the outer shell. A side wall of the inner sleeve is spaced from a side wall of the outer shell along a radial direction. A distal end of the side wall of the inner sleeve is spaced from an end wall of the outer shell by a gap along the axial direction. The inner sleeve divides the interior volume into a first muffler cavity and a second muffler cavity. The side wall of the inner sleeve is positioned between the first muffler cavity and the second muffler cavity along the radial direction. The first muffler cavity is contiguous with the second muffle cavity at the gap between the distal end of the side wall of the inner sleeve and the end wall of the outer shell.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
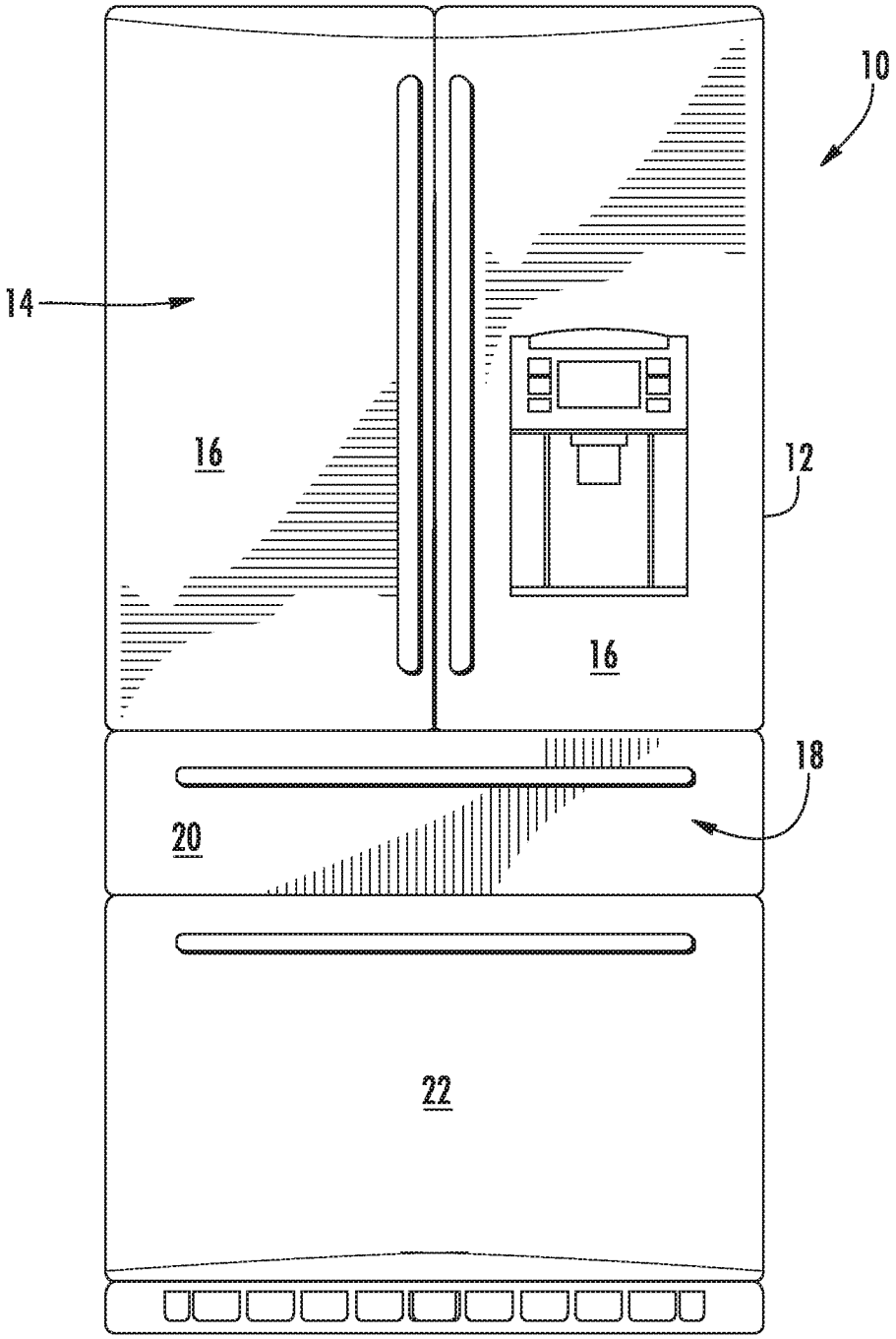
FIG. 1 is a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
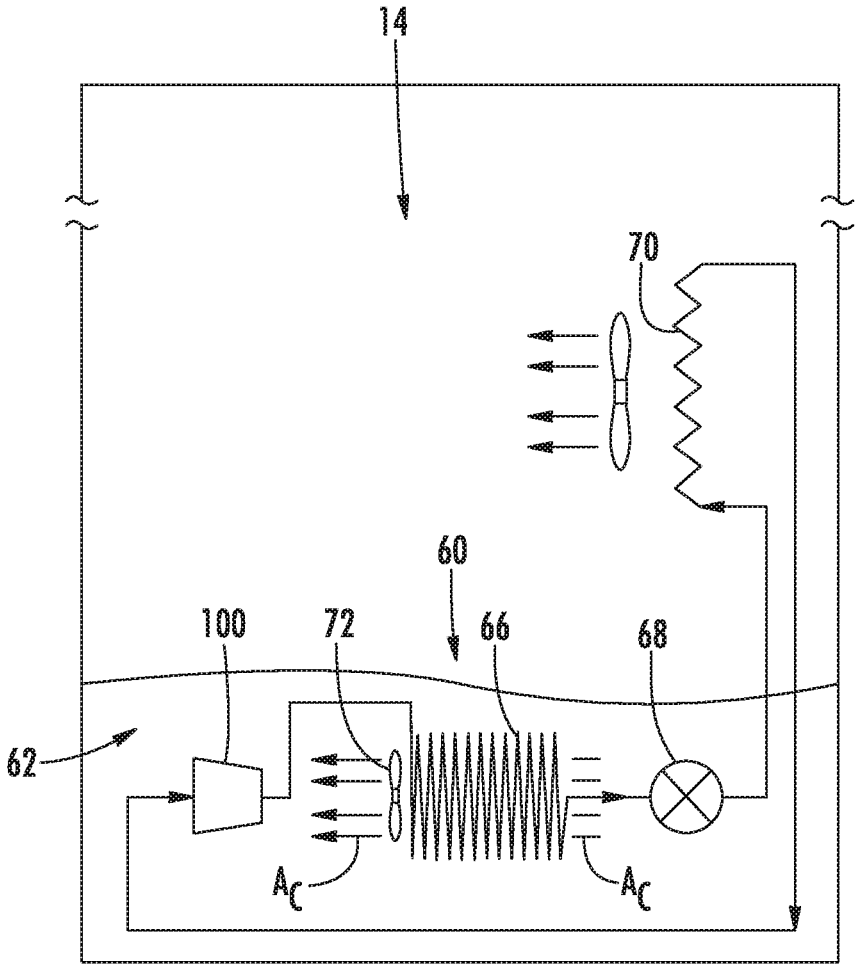
FIG. 2 is schematic view of certain components of the exemplary refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated exemplary embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 100, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 100, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

Figure 3:
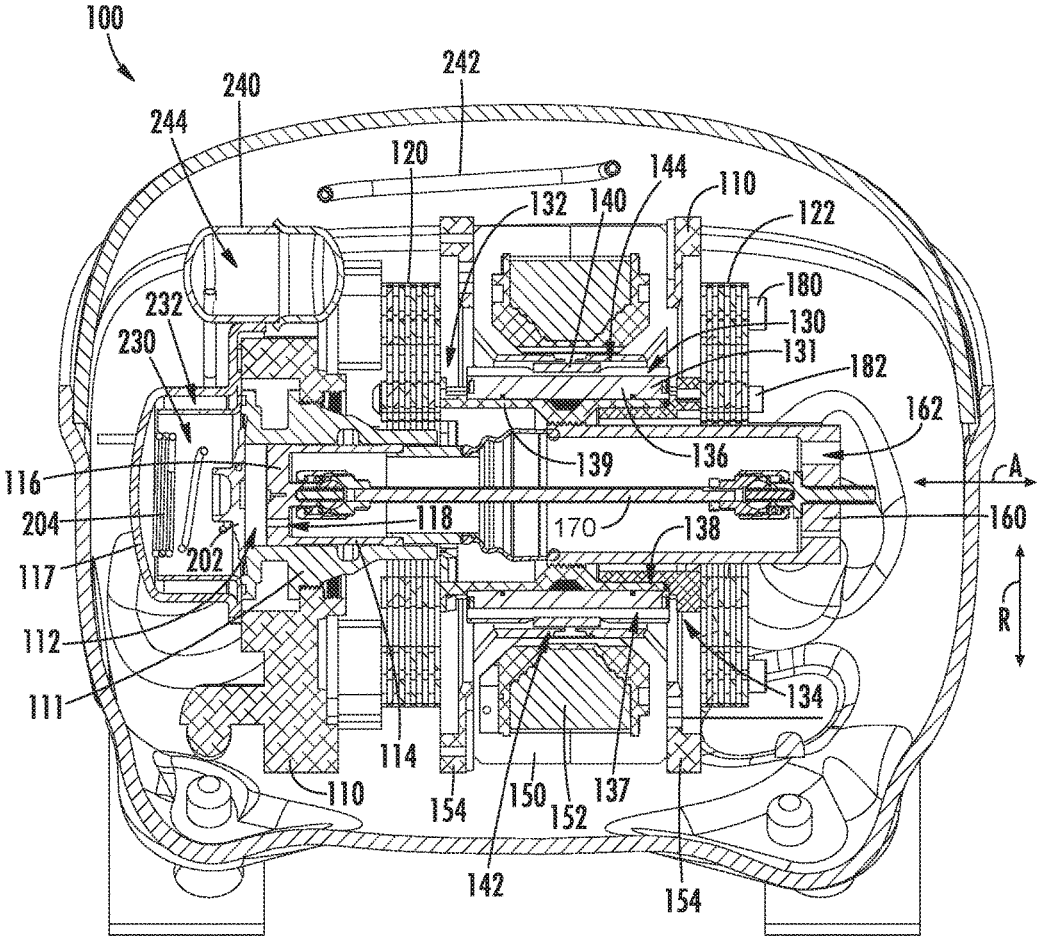
FIG. 3 provides a section view of a linear compressor according to an exemplary embodiment of the present subject matter.

FIG. 3 provides a section view of a linear compressor 100 according to an exemplary embodiment of the present subject matter. It will be understood that linear compressor 100 is provided by way of example only and that the present subject matter may be used in or with any suitable compressor in alternative exemplary embodiments. For example, the present subject matter may be used in or with any of the linear compressors described in U.S. Pat. No. 9,562,525, 9,506,460 or 9,429,150, all of which are incorporated by reference in their entireties.

Figure 4:
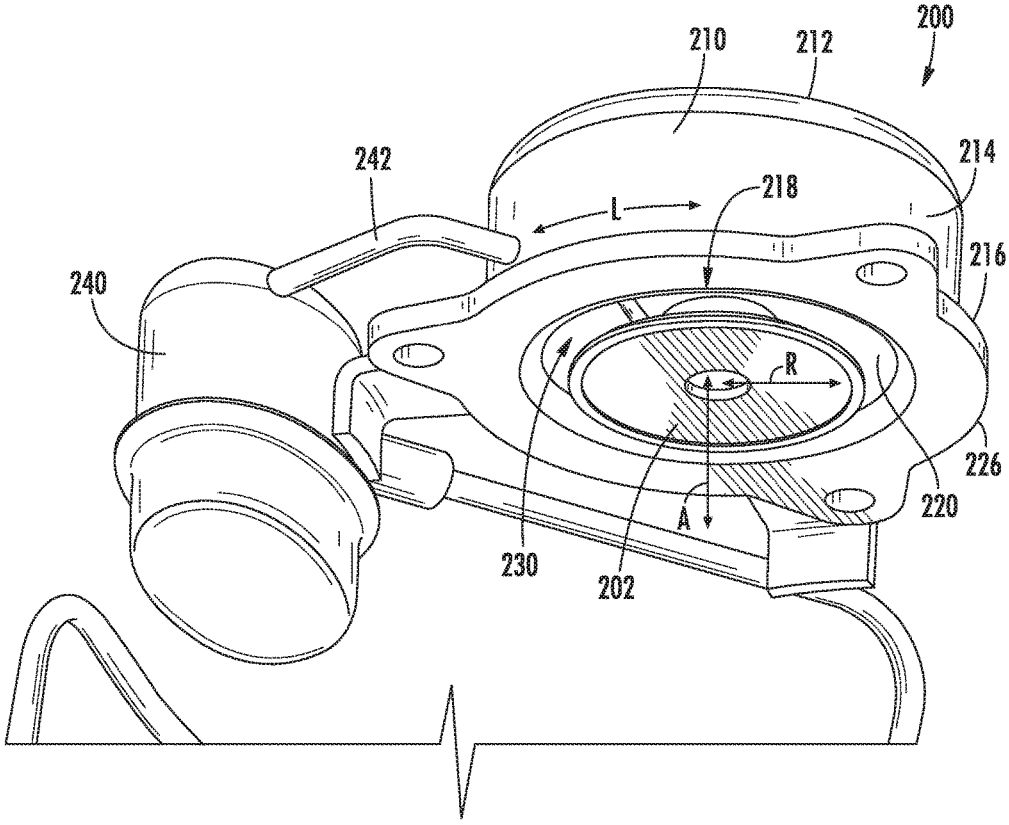
FIG. 4 provides a perspective view of a discharge valve assembly according to an exemplary embodiment of the present subject matter.
Figure 6:
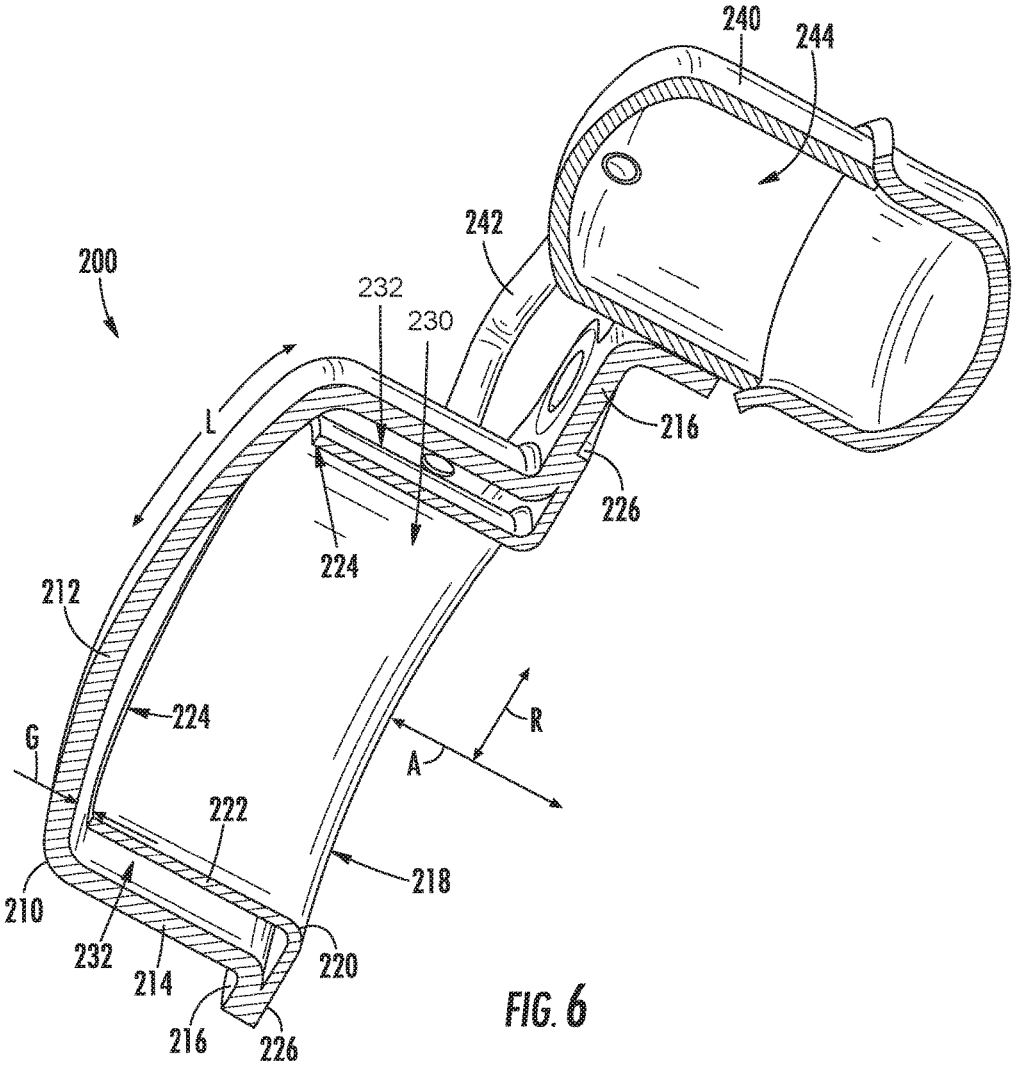
FIG. 6 provides a section view of certain components of the exemplary discharge valve assembly of FIG. 4.

As discussed in greater detail below, linear compressor 100 is operable to increase a pressure of fluid within a chamber 112 of linear compressor 100. Linear compressor 100 may be used to compress any suitable fluid, such as refrigerant or air. In particular, linear compressor 100 may be used in a refrigerator appliance, such as refrigerator appliance 10 (FIG. 1). Linear compressor 100 defines an axial direction A, a radial direction R and a circumferential direction L (FIGS. 4 and 6). Linear compressor 100 may be enclosed within a hermetic or air-tight shell, as shown. The hermetic shell can, e.g., hinder or prevent refrigerant from leaking or escaping from refrigeration system 60.

Turning now to FIG. 3, linear compressor 100 includes a casing 110 that extends, e.g., along the axial direction A. Casing 110 includes various static or non-moving structural components of linear compressor 100. In particular, casing 110 includes a cylinder assembly 111 that defines a chamber 112. Chamber 112 extends longitudinally along the axial direction A. A stator, e.g., including an outer back iron 150 and a driving coil 152, of the motor is mounted or secured to casing 110. Linear compressor 100 also includes valves (such as a discharge valve assembly 117 at an end of chamber 112) that permit refrigerant to enter and exit chamber 112 during operation of linear compressor 100.

A piston assembly 114 with a piston head 116 is slidably received within chamber 112 of cylinder assembly 111. In particular, piston assembly 114 is slidable along the axial direction A. During sliding of piston head 116 within chamber 112, piston head 116 compresses refrigerant within chamber 112. As an example, from a top dead center position, piston head 116 can slide within chamber 112 towards a bottom dead center position along the axial direction A, i.e., an expansion stroke of piston head 116. When piston head 116 reaches the bottom dead center position, piston head 116 changes directions and slides in chamber 112 back towards the top dead center position, i.e., a compression stroke of piston head 116. It should be understood that linear compressor 100 may include an additional piston head and/or additional chamber at an opposite end of linear compressor 100. Thus, linear compressor 100 may have multiple piston heads in alternative exemplary embodiments.

As may be seen in FIG. 3, linear compressor 100 also includes an inner back iron assembly 130. Inner back iron assembly 130 is positioned in the stator of the motor. In particular, outer back iron 150 and/or driving coil 152 may extend about inner back iron assembly 130, e.g., along the circumferential direction L. Inner back iron assembly 130 also has an outer surface 137. At least one driving magnet 140 is mounted to inner back iron assembly 130, e.g., at outer surface 137 of inner back iron assembly 130. Driving magnet 140 may face and/or be exposed to driving coil 152. In particular, driving magnet 140 may be spaced apart from driving coil 152, e.g., along the radial direction R by an air gap. Thus, the air gap may be defined between opposing surfaces of driving magnet 140 and driving coil 152. Driving magnet 140 may also be mounted or fixed to inner back iron assembly 130 such that an outer surface of driving magnet 140 is substantially flush with outer surface 137 of inner back iron assembly 130. Thus, driving magnet 140 may be inset within inner back iron assembly 130. In such a manner, the magnetic field from driving coil 152 may have to pass through only a single air gap between outer back iron 150 and inner back iron assembly 130 during operation of linear compressor 100, and linear compressor 100 may be more efficient relative to linear compressors with air gaps on both sides of a driving magnet.

As may be seen in FIG. 3, driving coil 152 extends about inner back iron assembly 130, e.g., along the circumferential direction L. Driving coil 152 is operable to move the inner back iron assembly 130 along the axial direction A during operation of driving coil 152. As an example, a current may be induced within driving coil 152 by a current source (not shown) to generate a magnetic field that engages driving magnet 140 and urges piston assembly 114 to move along the axial direction A in order to compress refrigerant within chamber 112 as described above and will be understood by those skilled in the art. In particular, the magnetic field of driving coil 152 may engage driving magnet 140 in order to move inner back iron assembly 130 and piston head 116 along the axial direction A during operation of driving coil 152. Thus, driving coil 152 may slide piston assembly 114 between the top dead center position and the bottom dead center position, e.g., by moving inner back iron assembly 130 along the axial direction A, during operation of driving coil 152.

Linear compressor 100 may include various components for permitting and/or regulating operation of linear compressor 100. In particular, linear compressor 100 includes a controller (not shown) that is configured for regulating operation of linear compressor 100. The controller is in, e.g., operative, communication with the motor, e.g., driving coil 152 of the motor. Thus, the controller may selectively activate driving coil 152, e.g., by inducing current in driving coil 152, in order to compress refrigerant with piston assembly 114 as described above.

The controller includes memory and one or more processing devices such as microprocessors, CPUs or the like, such as general or special purpose microprocessors operable to execute programming instructions or micro-control code associated with operation of linear compressor 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Linear compressor 100 also includes a pair of planar spring assemblies, e.g., a first planar spring assembly 120 and a second planar spring assembly 122, mounted to inner back iron assembly 130 at opposite sides of inner back iron assembly 130. For example, first planar spring assembly 120 may be mounted or fixed to inner back iron assembly 130 at first end portion 132 of inner back iron assembly 130. Conversely, second planar spring assembly 122 may be mounted to inner back iron assembly 130 at second end portion 134 of inner back iron assembly 130. Thus, first and second planar spring assemblies 120 and 122 may be spaced apart from each other along the axial direction A, and inner back iron assembly 130 may extend between and couple first and second planar spring assemblies 120 and 122 together. First and second planar spring assemblies 120 and 122 are also mounted to the stator of the motor and positioned at opposite sides of the stator of the motor. First planar spring assembly 120 may also be positioned at or adjacent cylinder assembly 111.

During operation of driving coil 152, first and second planar spring assemblies 120 and 122 support inner back iron assembly 130. In particular, inner back iron assembly 130 is suspended between first and second planar spring assemblies 120 and 122 such that motion of inner back iron assembly 130 along the radial direction R is hindered or limited while motion along the axial direction A is relatively unimpeded. Thus, first and second planar spring assemblies 120 and 122 may be substantially stiffer along the radial direction R than along the axial direction A. In such a manner, first and second planar spring assemblies 120 and 122 can assist with maintaining a uniformity of an air gap between driving magnet 140 and outer back iron 150 or driving coil 152, e.g., along the radial direction R, during operation of the motor and movement of inner back iron assembly 130 along the axial direction A. First and second planar spring assemblies 120 and 122 can also assist with hindering side pull forces of the motor from transmitting to piston assembly 114 to be reacted in cylinder assembly 111 as a friction loss.

Each of first and second planar spring assemblies 120 and 122 includes a plurality of planar springs, e.g., two, three, four, five, six or more planar springs. The planar springs are mounted or secured to one another. In particular, the planar springs may be mounted or secured to one another such that the planar springs are spaced apart from one another, e.g., along the axial direction A. In addition, a first plurality of fasteners 180 and a second plurality of fasteners 182 may be used to couple the planar springs to one another. In particular, first fasteners 180 may extend through the planar springs at an inner diameter or portion of the planar springs, and second fasteners 182 may extend through the planar springs at an outer diameter or portion of the planar springs.

First and second fasteners 180 and 182 may also assist with mounting first and second planar spring assemblies 120, 122 to inner back iron assembly 130 and the stator of the motor. In particular, as may be seen in FIG. 3, first fasteners 180 may extend through second planar spring assembly 122 into inner back iron assembly 130 at the inner portion of the planar springs, and second fasteners 182 may extend through second planar spring assembly 122 into the stator of the motor (e.g., a bracket 154 of the stator) at the outer portion of the planar springs.

Inner back iron assembly 130 includes an outer cylinder 136 and a sleeve 139. Outer cylinder 136 defines outer surface 137 of inner back iron assembly 130 and also has an inner surface 138 positioned opposite outer surface 137 of outer cylinder 136. Sleeve 139 is positioned on or at inner surface 138 of outer cylinder 136. A first interference fit between outer cylinder 136 and sleeve 139 may couple or secure outer cylinder 136 and sleeve 139 together. In alternative exemplary embodiments, sleeve 139 may be welded, glued, fastened, or connected via any other suitable mechanism or method to outer cylinder 136. Sleeve 139 extends within outer cylinder 136, e.g., along the axial direction A, between first and second end portions 132 and 134 of inner back iron assembly 130.

Outer cylinder 136 may be constructed of or with any suitable material. For example, outer cylinder 136 may be constructed of or with a plurality of (e.g., ferromagnetic) laminations 131. Laminations 131 are distributed along the circumferential direction L in order to form outer cylinder 136. Laminations 131 are mounted to one another or secured together, e.g., with rings press-fit into first and second end portions 132 and 134 of inner back iron assembly 130. Outer cylinder 136, e.g., laminations 131, define a recess 144 that extends inwardly from outer surface 137 of outer cylinder 136, e.g., along the radial direction R. Driving magnet 140 is positioned in recess 144, e.g., such that driving magnet 140 is inset within outer cylinder 136.

A piston flex mount 160 is mounted to and extends through inner back iron assembly 130. In particular, piston flex mount 160 is mounted to inner back iron assembly 130 via sleeve 139. Thus, piston flex mount 160 may be coupled (e.g., threaded) to sleeve 139 in order to mount or fix piston flex mount 160 to inner back iron assembly 130. A coupling 170 extends between piston flex mount 160 and piston assembly 114, e.g., along the axial direction A. Thus, coupling 170 connects inner back iron assembly 130 and piston assembly 114 such that motion of inner back iron assembly 130, e.g., along the axial direction A, is transferred to piston assembly 114.

Coupling 170 may be a compliant coupling that is compliant or flexible along the radial direction R. In particular, coupling 170 may be sufficiently compliant along the radial direction R such that little or no motion of inner back iron assembly 130 along the radial direction R is transferred to piston assembly 114 by coupling 170. In such a manner, side pull forces of the motor are decoupled from piston assembly 114 and/or cylinder assembly 111 and friction between piston assembly 114 and cylinder assembly 111 may be reduced.

Piston flex mount 160 defines at least one suction gas inlet 162. Suction gas inlet 162 of piston flex mount 160 extends, e.g., along the axial direction A, through piston flex mount 160. Thus, a flow of fluid, such as air or refrigerant, may pass through piston flex mount 160 via suction gas inlet 162 of piston flex mount 160 during operation of linear compressor 100.

Piston head 116 also defines at least one opening 118. Opening 118 of piston head 116 extends, e.g., along the axial direction A, through piston head 116. Thus, the flow of fluid may pass through piston head 116 via opening 118 of piston head 116 into chamber 112 during operation of linear compressor 100. In such a manner, the flow of fluid (that is compressed by piston head 116 within chamber 112) may flow through piston flex mount 160 and inner back iron assembly 130 to piston assembly 114 during operation of linear compressor 100.

Figure 5:
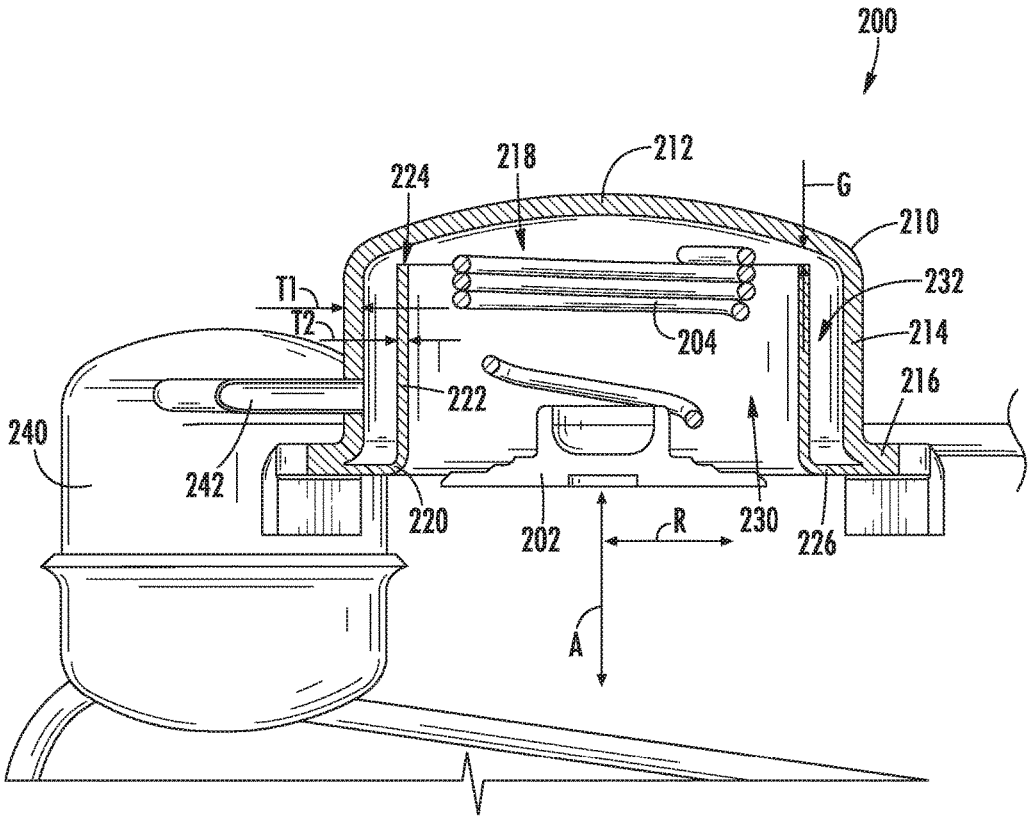
FIG. 5 provides a section view of the exemplary discharge valve assembly of FIG. 4.

FIG. 4 provides a perspective view of a discharge valve 200 according to an exemplary embodiment of the present subject matter. FIG. 5 provides a section view of discharge valve 200. FIG. 6 provides a section view of certain components of discharge valve 200. Discharge valve 200 is described in greater detail below in the context of linear compressor 100. Thus, discharge valve 200 may be used as discharge valve assembly 117. However, it should be understood that discharge valve 200 may be used in or with any suitable compressor in alternative exemplary embodiments, e.g., to regulate pressurized fluid flow from a chamber. As discussed in greater detail below, discharge valve 200 includes features for limiting pressure pulsations of refrigerant from chamber 112 and reducing noise during operation of linear compressor 100.

As may be seen in FIGS. 4 through 6, discharge valve 200 includes a valve head 202, a spring 204, an outer shell 210 and an inner sleeve 220. Outer shell 210 has an end wall 212 and a side wall 214. Side wall 214 may be cylindrical and is mounted to end wall 212. An inner surface of end wall 212 may be concave. Side wall 214 extends from end wall 212, e.g., along the axial direction A, to cylinder assembly 111 of casing 110. Outer shell 210 may be mounted or fixed to casing 110, and other components of discharge valve 200 may be disposed within outer shell 210.

Valve head 202 is positioned within outer shell 210 at or adjacent chamber 112 of cylinder assembly 111. As shown in FIG. 5, spring 204 may be coupled to outer shell 210 and valve head 202 within outer shell 210. Spring 204 is configured to urge valve head 202 towards or against cylinder assembly 111, e.g., along the axial direction A. One end of spring 204 may be mounted to end wall 212 of outer shell 210, and another end of spring 204 may be mounted to valve head 202. Thus, spring 204 may be compressed between end wall 212 (e.g., a bracket on end wall 212) and valve head 202 within outer shell 210. Spring 204 may be a coil or helical spring in certain exemplary embodiments.

Valve head 202 is adjustable between an open position (not shown) and a closed position (FIG. 5). Thus, valve head 202 is moveable, e.g., along the axial direction A, relative to casing 110. In particular, during operation of linear compressor 100, piston assembly 114 reciprocates within chamber 112 and pressurizes fluid, and valve head 202 shifts between the open and closed positions. For example, spring 204 bias valve head 202 towards the closed position. Thus, valve head 202 is normally closed. When valve head 202 is in the closed position, valve head 202 may be seated against cylinder assembly 111 and thus assist with sealing chamber 112. When valve head 202 is closed, discharge valve 200 may seal chamber 112 and thereby assist with pressurization of fluid due to motion of piston assembly 114 within chamber 112.

When the fluid in chamber 112 reaches a threshold pressure, valve head 202 may open. For example, fluid within chamber 112 may apply a force onto valve head 202 that overcomes the force applied to valve head 202 by spring 204 such that valve head 202 moves, e.g., along the axial direction A, away from cylinder assembly 111 to the open position. When valve head 202 is in the open position, fluid from chamber 112 may flow out of chamber 112 and into outer shell 210.

Inner sleeve 220 is positioned within outer shell 210. In particular, a side wall 222 of inner sleeve 220 is positioned within outer shell 210. Side wall 222 of inner sleeve 220 may be open at a top and bottom of inner sleeve 220, e.g., such that inner sleeve 220 does not have end walls within outer shell 210. Side wall 222 of inner sleeve 220 is spaced from side wall 214 of outer shell 210, e.g., along the radial direction R. Thus, side wall 214 of outer shell 210 may extend around side wall 222 of inner sleeve 220 along the circumferential direction L. Side wall 222 of inner sleeve 220 may be cylindrical and be concentrically positioned within side wall 214 of outer shell 210. A distal end 224 of side wall 222 of inner sleeve 220 is spaced from end wall 212 of outer shell 210 by a gap G, e.g., along the axial direction A. Thus, inner sleeve 220 may not contact end wall 212 of outer shell 210.

Inner sleeve 220 divides an interior volume 218 of outer shell 210 into a first muffler cavity 230 and a second muffler cavity 232. In particular, side wall 222 of inner sleeve 220 is positioned between first muffler cavity 230 and second muffler cavity 232, e.g., along the radial direction R. Thus, second muffler cavity 232 may extend around first muffler cavity 230, e.g., along the circumferential direction L. Dividing interior volume 218 of outer shell 210 into first and second muffler cavities 230, 232 assists with reducing pressure pulsations within refrigerant from chamber 112, e.g., relative to a single muffler cavity.

First muffler cavity 230 is contiguous with second muffle cavity 232 at the gap G between distal end 224 of side wall 222 and end wall 212 of outer shell 210. First muffler cavity 230 is also contiguous with chamber 112 when valve head 202 is open. Thus, compressed refrigerant from chamber 112 may flow from first muffler cavity 230 between distal end 224 of side wall 222 and end wall 212 of outer shell 210 to second muffler cavity 232 via the gap G. Side wall 222 of inner sleeve 220 may be imperforated, and the gap G may be the only flow path for refrigerant between first muffler cavity 230 and second muffler cavity 232, in certain exemplary embodiments.

The gap G may be sized to facilitate reduction of pressure pulsations within refrigerant from chamber 112. For example, the gap G between distal end 224 of side wall 222 and end wall 212 of outer shell 210 may be no greater than a quarter of an inch (0.25"), e.g., along the axial direction A. Such sizing of the gap G may reduce pressure pulsations of refrigerant between first and second muffler cavities 230, 232 and thereby reduce operating noise of linear compressor 100, e.g., relative to a single muffler cavity.

Outer shell 210 and inner sleeve 220 may be constructed of discrete pieces of stamped sheet metal or die cast material. As an example and as may be seen in FIG. 5, side wall 214 of outer shell 210 may have a thickness T1 along the radial direction R, and side wall 222 of inner sleeve 220 may have a thickness T2 along the radial direction R. The thickness T1 of side wall 214 of outer shell 210 may be greater than the thickness T2 of side wall 222 of inner sleeve 220. Thus, e.g., outer shell 210 may stamped from sheet metal having a lesser gauge than inner sleeve 220.

Outer shell 210 and inner sleeve 220 may be joined together in any suitable manner. For example, outer shell 210 may have a flange 216. Flange 216 of outer shell 210 may be positioned opposite end wall 212 on side wall 214 of outer shell 210, e.g., along the axial direction A. Thus, flange 216 of outer shell 210 may be spaced from end wall 212 of outer shell 210, e.g., along the axial direction A. Inner sleeve 220 may also have a flange 226. Flange 226 of inner sleeve 220 may be positioned opposite distal end 224 of inner sleeve 220 on side wall 222 of inner sleeve 220, e.g., along the axial direction A. Thus, flange 226 of inner sleeve 220 may be spaced from distal end 224 of inner sleeve 220, e.g., along the axial direction A.

Flange 226 of inner sleeve 220 may be positioned on cylinder assembly 111. For example, a seal, such as a O-ring may extend between cylinder assembly 111 and flange 226 of inner sleeve 220, e.g., along the axial direction A, in order to limit fluid leakage at an axial gap between casing 110 and discharge valve 200. Flange 216 of outer shell 210 may be positioned over flange 226 of inner sleeve 220. Thus, flange 226 of inner sleeve 220 may be positioned between flange 216 of outer shell 210 and cylinder assembly 111, e.g., along the axial direction A. Fasteners may extend through flange 216 of outer shell 210 and/or flange 226 of inner sleeve 220 into casing 110 in order to mount discharge valve 200 to casing 110. Flange 216 of outer shell 210 may be brazed to flange 226 of inner sleeve 220, e.g., in a brazing oven, to mount outer shell 210 to inner sleeve 220.

Discharge valve 200 may also include an additional muffler casing 240 and a connecting conduit 242. Additional muffler casing 240 is separate and/or spaced from outer shell 210. Additional muffler casing 240 defines a third muffler cavity 244. Connecting conduit 242 extends between outer shell 210 and additional muffler casing 240 such that refrigerant from second muffle cavity 232 is flowable through connecting conduit 242 to third muffler cavity 244. For example, connecting conduit 242 may extend through outer shell 210 such that one end of connecting conduit 242 is positioned at second muffler cavity 232, and connecting conduit 242 may extend through additional muffler casing 240 such that another end of connecting conduit 242 is positioned at third muffler cavity 244.

Adding third muffler cavity 244 may assist first and second muffler cavities 230, 232 with reducing pressure pulsations within refrigerant from chamber 112, e.g., relative to a single muffler cavity or double muffler cavities. As an example, discharge valve 200 may be configured with first muffler cavity 230, second muffler cavity 232 and third muffler cavity 244 positioned in series with one another such that discharge refrigerant from chamber 112 flows into first muffler cavity 230 then to second muffler cavity 232 and finally to third muffler cavity 244. Thus, third muffler cavity 244 may be positioned downstream of first and second muffler cavities 230, 232, and second muffler cavity 232 may be positioned downstream of first muffler cavity 230 within discharge valve 200, e.g., relative to a flow of compressed refrigerant from chamber 112.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A compressor, comprising:

a casing defining a chamber;

a piston disposed within the chamber of the casing, the piston reciprocable within the chamber of the casing along an axial direction;

a discharge valve assembly comprising an outer shell defining an interior volume;

a valve head positioned within the outer shell adjacent the chamber of the casing;

a spring coupled to the valve head such that the spring urges the valve head towards the casing; and an inner sleeve positioned within the outer shell, a side wall of the inner sleeve spaced from a side wall of the outer shell along a radial direction, a distal end of the side wall of the inner sleeve spaced from an end wall of the outer shell by a gap along the axial direction, wherein the inner sleeve dividing the interior volume into a first muffler cavity and a second muffler cavity, the side wall of the inner sleeve positioned between the first muffler cavity and the second muffler cavity along the radial direction, the first muffler cavity contiguous with the second muffler cavity at the gap between the distal end of the side wall of the inner sleeve and the end wall of the outer shell, and wherein the spring is coupled to the end wall of the outer shell and the valve head, the spring extends from the end wall of the outer shell to the valve head within the outer shell, and the spring is compressed between the end wall of the outer shell and the valve head within the outer shell.

2. The compressor of claim 1, wherein the gap between the distal end of the side wall of the inner sleeve and the end wall of the outer shell is no greater than a quarter of an inch along the axial direction.

3. The compressor of claim 1, wherein an inner surface of the end wall of the outer shell is concave.

4. The compressor of claim 1, wherein the side wall of the outer shell has a thickness along the radial direction, the side wall of the inner sleeve has a thickness along the radial direction, the thickness of the side wall of the outer shell being greater than the thickness of the side wall of the inner sleeve.

5. The compressor of claim 1, wherein a flange of the inner sleeve is positioned on the casing, the flange of the inner sleeve positioned opposite the distal end of the side wall of the inner sleeve.

6. The compressor of claim 5, wherein a flange of the outer shell is positioned over the flange of the inner sleeve.

7. The compressor of claim 1, wherein the discharge valve assembly further comprises an additional muffler casing and a connecting conduit, the additional muffler casing separate from the outer shell and defining a third muffler cavity, the connecting conduit extending between the outer shell and the additional muffler casing.

8. The compressor of claim 7, wherein the connecting conduit extends through the outer shell such that one end of the connecting conduit is positioned at the second muffler cavity, another end of the connecting conduit positioned at the third muffler cavity.

9. The compressor of claim 1, wherein the second muffler cavity extends around the first muffler cavity along a circumferential direction.

10. A discharge valve assembly for a compressor, comprising:

an outer shell defining an interior volume;

a valve head positioned within the outer shell;

a spring positioned within the outer shell and coupled to the valve head; and an inner sleeve positioned within the outer shell, a side wall of the inner sleeve spaced from a side wall of the outer shell along a radial direction, an open distal end of the side wall of the inner sleeve spaced from an end wall of the outer shell by a gap along the axial direction, wherein the inner sleeve dividing the interior volume into a first muffler cavity and a second muffler cavity, the side wall of the inner sleeve positioned between the first muffler cavity and the second muffler cavity along the radial direction, the first muffler cavity contiguous with the second muffler cavity at the gap between the open distal end of the side wall of the inner sleeve and the end wall of the outer shell, and wherein the spring extends from the end wall of the outer shell to the valve head within the outer shell.

11. The discharge valve assembly of claim 10, wherein the gap between the open distal end of the side wall of the inner sleeve and the end wall of the outer shell is no greater than a quarter of an inch along the axial direction.

12. The discharge valve assembly of claim 10, wherein an inner surface of the end wall of the outer shell is concave.

13. The discharge valve assembly of claim 10, wherein the side wall of the outer shell has a thickness along the radial direction, the side wall of the inner sleeve has a thickness along the radial direction, the thickness of the side wall of the outer shell being greater than the thickness of the side wall of the inner sleeve.

14. The discharge valve assembly of claim 10, wherein a flange of the inner sleeve is positioned opposite the open distal end of the side wall of the inner sleeve.

15. The discharge valve assembly of claim 14, wherein a flange of the outer shell is positioned on the flange of the inner sleeve.

16. The discharge valve assembly of claim 10, wherein the discharge valve assembly further comprises an additional muffler casing and a connecting conduit, the additional muffler casing separate from the outer shell and defining a third muffler cavity, the connecting conduit extending between the outer shell and the additional muffler casing.

17. The discharge valve assembly of claim 16, wherein the connecting conduit extends through the outer shell such that one end of the connecting conduit is positioned at the second muffler cavity, another end of the connecting conduit positioned at the third muffler cavity.

18. The discharge valve assembly of claim 10, wherein the second muffler cavity extends around the first muffler cavity along a circumferential direction.

19. The discharge valve assembly of claim 10, wherein the side wall of the inner sleeve is imperforate.

* * * * *